US006880222B2

(12) United States Patent
Matsunaga

(10) Patent No.: US 6,880,222 B2
(45) Date of Patent: Apr. 19, 2005

(54) METHOD OF MANUFACTURING A GOLF CLUB HEAD

(75) Inventor: Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/691,526

(22) Filed: Oct. 24, 2003

(65) Prior Publication Data

US 2004/0078955 A1 Apr. 29, 2004

Related U.S. Application Data

(62) Division of application No. 10/188,043, filed on Jul. 3, 2002.

(30) Foreign Application Priority Data

Jul. 5, 2001 (JP) ..... P.2001-204996
May 14, 2002 (JP) ..... P.2002-138792

(51) Int. Cl.[7] ..... B23P 11/00

(52) U.S. Cl. ..... 29/428; 29/527.5; 148/405; 148/DIG. 3; 473/324; 473/345; 164/113

(58) Field of Search ..... 29/428, 527.5, 29/527.6, 527.7; 148/405, 420, DIG. 3; 164/80, 113, 129, 284; 473/324, 328, 344, 345, 349; 228/101; 219/617

(56) References Cited

U.S. PATENT DOCUMENTS 4,438,931 A 3/1984 Motomiya
5,205,560 A * 4/1993 Hoshi et al. ..... 473/345
5,232,224 A * 8/1993 Zeider ..... 473/345
5,255,913 A 10/1993 Tsuchida
5,301,945 A * 4/1994 Schmidt et al. ..... 473/311
5,310,185 A * 5/1994 Viollaz et al. ..... 473/330
5,346,217 A 9/1994 Tsuchiya et al.
5,378,295 A * 1/1995 Yamashita et al. ..... 148/654
5,485,998 A * 1/1996 Kobayashi ..... 473/345
5,755,627 A * 5/1998 Yamazaki et al. ..... 473/345
5,961,394 A * 10/1999 Minabe ..... 473/305
6,162,130 A * 12/2000 Masumoto et al. ..... 473/324
6,238,301 B1 * 5/2001 Takeda ..... 473/324
6,334,817 B1 * 1/2002 Ezawa et al. ..... 473/324
6,339,869 B1 * 1/2002 Peterson ..... 29/527.5
6,440,011 B1 * 8/2002 Hocknell et al. ..... 473/342

FOREIGN PATENT DOCUMENTS

JP 3-126474 5/1991
JP 4-89071 3/1992
JP 4-135576 5/1992

* cited by examiner

*Primary Examiner*—David P. Bryant
*Assistant Examiner*—Jermie E. Cozart
(74) *Attorney, Agent, or Firm*—Sughrue Mion, PLLC

(57) ABSTRACT

A golf club head has a face portion, a crown portion, a sole portion, a side portion and a hosel portion. Each portion is made of titanium or a titanium alloy. The side portion is formed integrally entirely from its toe side to its back side and its heel side. The side portion and the hosel portion are cast integrally. The face portion, the crown portion and the sole portion are molded separately from one another. The face portion, the crown portion, the sole portion and the side portion are welded integrally so as to form a golf club head. The Young's modulus of the crown portion is lower than any Young's modulus of the face portion, the sole portion, the side portion and the hosel portion.

5 Claims, 2 Drawing Sheets

METHOD OF MANUFACTURING A GOLF CLUB HEAD

This is a divisional of Application No. 10/188,043 filed Jul. 3, 2002; the disclosure of which is incorporated herein by reference.

This disclosure relates to the subject matter contained in Japanese Patent Application No.2001-204996 filed on Jul. 5, 2001, which is incorporated herein by reference in its entirety.

BACKGROUND OF THE INVENTION

1. Field of the Invention

The present invention relates to a hollow golf club head made of metal, and particularly relates to a golf club head having a wood type shape or a shape close to the wood type shape.

2. Description of the Related Art

Hollow golf club heads made of metal are used widely as wood type golf club heads such as drivers or fairway woods. Generally, as shown in FIG. 2, a hollow wood type golf club head 1 has a face portion 2 for hitting a ball, a crown portion 3 forming the top surface portion of the golf club head, a sole portion 4 forming the bottom surface portion of the golf club head, a side portion 5 forming the toe-side, back-side and heel-side side surface portions of the golf club head, and a hosel portion 6. A shaft 7 is inserted into the hosel portion 6 of the golf club head 1, and fixed thereto by a bonding agent or the like. Incidentally, recently, a lot of golf club heads called utility clubs have come onto the market. As a kind of such utility golf club head, various golf club heads resembling the wood type golf club head (that is, having a face portion, a sole portion, a side portion and a crown portion) have also come onto the market.

As metal forming such a hollow golf club head, aluminum alloys, stainless steel, or titanium alloys are used. In recent years, titanium alloys are especially used widely.

In order to increase a carry of a shot with a hollow golf club head made of metal, development has been made while attention has been paid to the fact that the repulsion of a ball is increased by use of the bending of a face surface so as to hit the ball farther. However, for a golfer who has a low head speed, the deformation of the face surface in a golf club head of this type is insufficient so that the effect to increase the initial speed of the ball is reduced. In addition, the ball cannot be launched high. Thus, the carry may be not increased.

It is an object of the invention to provide a golf club head in which, even if a golfer who has a low head speed uses the golf club head, the launch angle is increased so that the carry can be increased consequently.

BRIEF SUMMARY OF THE INVENTION

A hollow golf club head according to the invention is made of metal. The golf club includes at least a face portion, a sole portion, a side portion, and a crown portion. A metal material forming the crown portion has a lowest Young's modulus.

In the golf club head according to the invention, the Young's modulus of the crown portion is made lower than that of any other member such as the sole portion. Thus, the launch angle of a ball at the time of impact can be increased. As a result, even if a golfer having a low head speed uses the golf club head, the launch angle becomes so high that the carry can be increased.

In the golf club head according to the invention, it is preferable that at least the crown portion is press-molded separately from other portions and joined to the other portions by welding or the like. Particularly, it is preferable that the face portion, the sole portion, the side portion and the crown portion are molded separately from one another, and then joined to one another. In such a manner, metal materials having Young's modulus suitable for the respective portions can be selected as metal materials for forming the respective portions.

The side portion may be formed sequentially and integrally on its toe-side, back-side and heel-side, or may be molded separately in two or more parts.

Generally, the golf club head according to the invention also has a hosel portion. This hosel portion may be molded integrally with one or more portions of the sole portion, the side portion and the crown portion, or may be molded separately from these portions.

In order to make the crown portion easy to bend, it is preferable that the crown portion may be made to have thickness in a range of from 0.5 mm to 1.2 mm.

According to the invention, it is preferable that the metal forming the golf club head includes at least one of titanium and titanium alloy, that the crown portion has a Young's modulus not higher than 10,500 kgf/mm$^2$ ($102.9\times10^9$ Pa), and that the sole portion has a Young's modulus not lower than 11,000 kgf/mm$^2$ ($107.8\times10^9$ Pa). It is also preferable that difference between Young's modulus of the crown portion and that of the sole portion is in a range of from 1,000 kgf/mm$^2$ to 3,000 kgf/mm$^2$ (in a range of from $9.8\times10^9$ Pa to $29.4\times10^9$ Pa).

It is preferable to apply the invention to a large-sized golf club head having a volume over 250 cc, especially over 300 cc, more especially over 350 cc. An example of such a golf club head is a driver. However, the invention is also applicable to a fairway wood, a utility golf club head resembling wood type one, and the like.

DETAILED DESCRIPTION OF THE PREFERRED EMBODIMENTS

Figure 1:
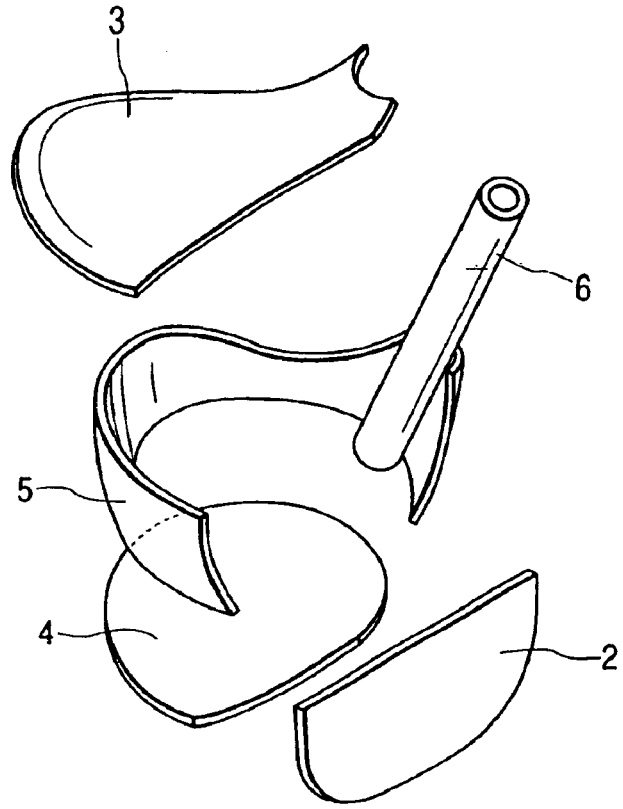
FIG. 1 is an exploded perspective view of a golf club head according to an embodiment of the invention.
Figure 2:
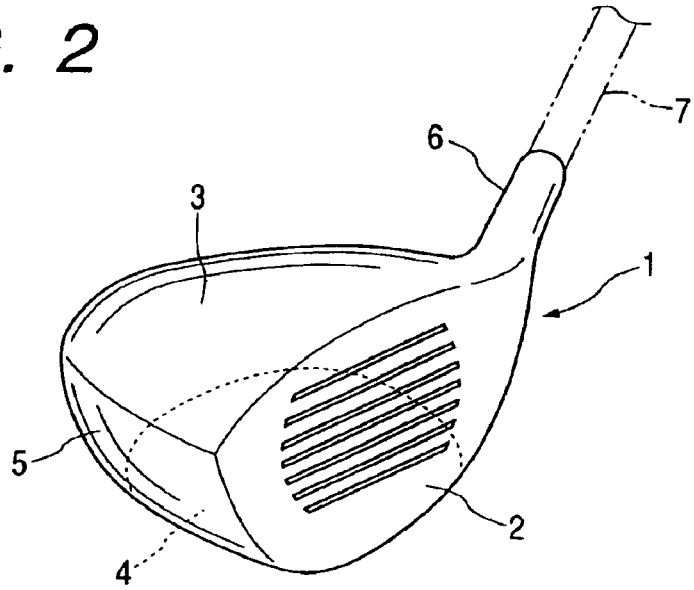
FIG. 2 is a perspective view of a related-art golf club head.
Figure 3A:
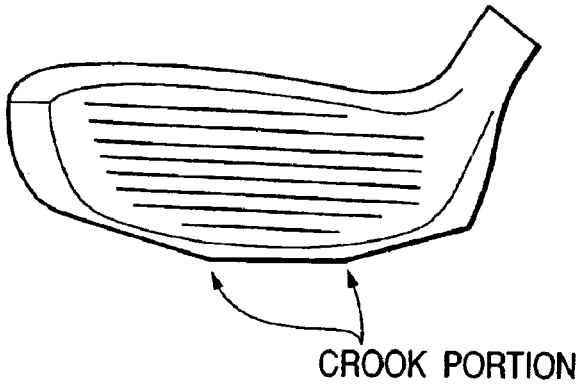
FIGS. 3A through 3D shows a crook portion of the golf club according the invention.
Figure 3B:
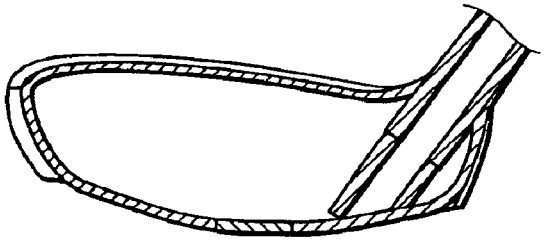
Figure 3C:
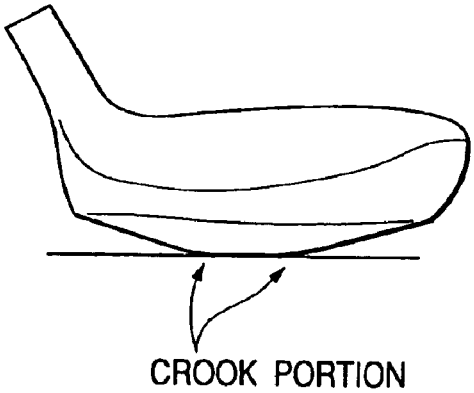
Figure 3D:
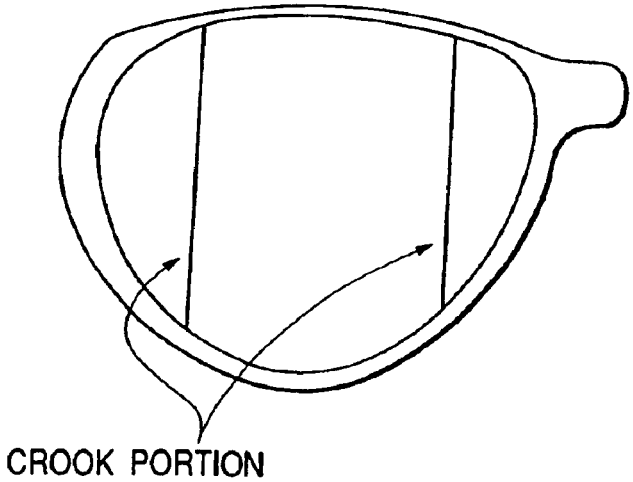

An embodiment of the invention will be described below with reference to the drawings. FIG. 1 is an exploded perspective view of a golf club head according to an embodiment of the invention.

This golf club head has a face portion 2, a crown portion 3, a sole portion 4, a side portion 5 and a hosel portion 6. The side portion 5 is formed integrally entirely from its toe side to its back side and its heel side. In addition, in this embodiment, the side portion 5 and the hosel portion 6 are molded integrally by casting. The face portion 2, the crown portion 3 and the sole portion 4 are molded separately, respectively.

The face portion 2, the crown portion 3, the sole portion 4 and the side portion 5 with the hosel portion are welded integrally so as to form a golf club head. The hosel portion 6 may be provided to reach the sole portion 4, or may be provided not to reach the sole portion 4. After the welding, various finishing processes such as polishing and painting are carried out if necessary, so as to form a product golf club head.

Each part forming the golf club head is made of titanium or a titanium alloy. The Young's modulus of the crown portion 3 is made lower than that of any other portion, that is, any one of the face portion 2, the sole portion 4, the side portion 5 and the hosel portion 6.

Since the Young's modulus of the crown portion 3 is made low in such a manner, the launch angle of a ball at the time of impact is high. Thus, even if a golfer having a low head speed uses the golf club head, a large carry can be obtained.

Incidentally, when the difference in Young's modulus between the crown portion and the sole portion is not smaller than 1,000 kgf/mm$^2$ ($9.8\times10^9$ Pa), especially not smaller than 1,500 kgf/mm$^2$ ($14.7\times10^9$ Pa), the crown portion becomes easier to bend so that a larger carry can be obtained. If the difference between the Young's modulus of the crown portion and that of the sole portion is excessive, the launch angle is higher. However, the repulsion of a ball deteriorate and the carry decreases. Therefore, the difference is preferably not more than 3,000 kgf/mm$^2$ ($29.4\times10^9$ Pa), more preferably not more than 2,600 kgf/mm$^2$ ($24.5\times10^9$ Pa).

Although the side portion 5 is formed sequentially and integrally from its toe side to its back side and its heel side in this embodiment, the side portion 5 may be divided into two or more small parts. In addition, although the side portion 5 and the hosel portion 6 are formed integrally in this embodiment, they may be molded separately from each other. Further, although the sole portion 4 and the side portion 5 are formed separately in this embodiment, the sole portion 4 and the side portion 5 may be molded integrally.

It is preferable that the face portion 2 and the crown portion 3 are molded separately from the other portions, respectively.

Next, description will be made on this molding method. Each of the face portion 2 and the crown portion 3 is preferably press-molded out of a plate material of a titanium alloy.

The face portion may be a rolled titanium alloy (preferable rolling ratio is in a range of 10% to 40%, especially in a range of 15% to 30%).

A rolled direction of a rolled titanium alloy constituting the crown portion preferably has an angle of 90°±10° with respect to a face surface.

This rolling is a process, which rotates a rolling machine having two or more rollers to pass metal between the rolls at normal or high temperature using the forgeability of the metal.

The rolling can adjust thickness of titanium alloy material precisely. Further, the rolling can improve mechanical characteristic thereof such as tensile strength.

When the crown portion made of titanium alloy having low Young's modulus is formed thinner than the side portion and the sole portion, the crown portion is more easily bent and the golf club head easily hits ball high. When the crown portion is rolled to be equal to the side portion and the sole portion in thickness, the crown portion has low Young's modulus to be easily bent and mechanical characteristic such as tensile strength is improved so that the crown portion strengthen against repeated deformation.

Generally, rolled material has different mechanical characteristic depending upon a rolled direction. Therefore, it is preferable that the rolled direction is selected so that the rolled material has the most strong mechanical characteristic against bending of the crown portion, that is, that the rolled direction is substantially perpendicular to the face surface, specifically the rolled direction has an angle of 90°±10° with respect to the face surface. Incidentally, rolling may be performed plural times. In this case, a rolled direction at each time may be different from each other.

The rolling ratio of titanium alloy is preferably in a range of 10% to 40%, more preferably in a range of 15% to 30%. Such rolling ratio improve mechanical characteristic of the titanium alloy to increase the tensile strength of the titanium alloy. When the titanium alloy is β-type titanium alloy, Young's modulus of the titanium alloy increases. Incidentally, if the rolling ratio is lower than 10%, effect of the rolling is insufficient.

If the side portion 5 is molded independently, it is preferable that the side portion 5 is molded by press-molding or casting. When the side portion 5 and the hosel portion 6 are molded integrally, casting is preferred. When the hosel portion 6 is molded independently, either casting or cutting into a pipe-like extrusion-molded material may be adopted. Alternatively, cutting such as boring may be carried out on a rod-like extrusion-molded material.

When the sole portion 4 is molded independently, casting or press-molding may be adopted. However, in order to increase the Young's modulus, it is preferable that the sole portion 4 is molded by casting. The sole portion 4 maybe cast or forged integrally with the side portion 5 or with the side portion 5 and the hosel portion 6. When the sole portion 4, the side portion 5 and the hosel portion 6 are cast integrally, even a portion having a complicated shape can be molded easily and accurately.

Incidentally, when the sole portion and the side portion are integrally formed by casting or forging, it is easy to manufacture a formed member including a portion having partially different thickness from other portion. For example, it is easy to manufacture a formed member in which the sole portion may be formed to be thick or in which a rib is formed on the sole portion.

In the invention, at least the sole portion 4 and the side portion 5 may be formed by press-molding. The sole portion, the side portion, and the like are formed by press-molding a metal plate, whereby it is possible to change thickness of each portion and/or to combine materials having different Young's modulus from each other.

Welding is preferable to joint the respective parts molded independently of one another.

Next, description will be made on the metal material forming the golf club head. It is preferable that each of the face portion 2, the crown portion 3, the sole portion 4 and the side portion 5 is made out of a titanium alloy. It is preferable that the hosel portion 6 is made out of pure titanium or a titanium alloy. When the side portion 5 and the hosel portion 6 are cast integrally, not to say, both the side portion 5 and the hosel portion 6 are made out of one and the same material.

As the titanium alloy for the crown portion 3, a β-type titanium alloy whose Young's modulus is not higher than 10,500 kgf/mm$^2$ ($10.29\times10^9$ Pa) is preferable. Examples of such a titanium alloy include Ti-15V-3Cr-3Sn-3Al, Ti-13V-11Cr-3Al, Ti-15Mo-5Zr, Ti-15Mo-5Zr-3Al, Ti-3Al-8V-6Cr-4Mo-4Zr, and Ti-22V-4Al.

As for the face portion 2, either the β-type titanium alloy which has been described above or an α-β-type titanium alloy which will be described later may be used.

Examples of a titanium alloy for the sole portion 4 include Ti-6Al-4V and Ti-6Al-6V-2Sn which are α-β-type titanium alloys with a Young's modulus not lower than 11,000 kgf/mm$^2$ (10.78×10$^9$ Pa), and Ti-8Al-1Mo-1V a near α-type titanium alloy with a Young's modulus not lower than 11,000 kgf/mm$^2$ (10.78×10$^9$ Pa). Further, Ti-3Al-8V-6Cr-4Mo-4Zr and Ti-22V-4Al which are β-type titanium alloys subjected to heat treatment so that the Young's modulus is in this range can be also used.

As for the side portion 5, the titanium alloy for the crown portion and the titanium alloy for the sole portion are preferred.

Examples of a material forming the hosel portion include pure titanium, Ti-3Al-2V which is an α-β-type titanium alloy, or a titanium alloy obtained by further adding sulfur and rare earth elements to Ti-3Al-2V to be thereby improved in machinability.

Generally, Young's modulus of β-type titanium alloys change in accordance with difference in heat treatment mode. The following Table 1 shows various treatment modes for titanium alloys and pure titanium, and Young's modulus of the titanium and the titanium alloys.

TABLE 1

| crystal structure | titanium alloy | Young's modulus (kg/mm$^2$) | application | preferable use portion |
|---|---|---|---|---|
| β | Ti—15V—3Cr—3Sn—3Al | 10,200–10,500 | forging | crown portion |
| β | Ti—13V—11Cr—3Al | 8,400–10,500 | forging | crown portion |
| β | Ti—15Mo—5Zr | 7,800–12,000 | forging | crown portion |
| β | Ti—15Mo—5Zr—3Al | 8,000–12,000 | forging | crown portion |
| β | Ti—3Al—8V—6Cr—4Mo—4Zr | 10,700–12,600 | forging | crown portion |
| β | Ti—22V—4Al | 8,900–11,000 | | crown portion |
| α-β | Ti—6Al—4V | 11,500 | forging/casting | sole portion |
| α-β | Ti—6Al—6V—2Sn | 11,300 | | sole portion |
| near α | Ti—8Al—1Mo—1V | 12,700 | forging | sole portion |
| | pure titanium | 10,850 | | hosel portion |
| α-β | Ti—3Al—2V (+ S + rare earth) | 10,900 | | hosel portion |

Incidentally, in the heat treatment of the β-type titanium alloy, it is preferable that age-hardening treatment is avoided on the material used for the crown portion so as to limit Young's modulus thereof to a low value. That is, for example, when one and the same β-type titanium alloy is used for the crown portion and the head body other than the crown portion, respectively, the β-type titanium alloy used for the head body other than the crown portion is age-hardened in advance, and the β-type titanium alloy which has not been age-hardened is then welded as the crown portion. The β-type titanium alloy welded as the crown portion is preferably subjected to annealing treatment or solution treatment in advance. The β-type titanium alloy may be used for the side portion as well as the crown portion. In this case, the β-type titanium alloy is not subjected to age-hardening treatment.

Next, description will be made on preferred dimensions of the respective portions of the golf club head.

It is preferable that the thickness of the crown portion 3 is not larger than 1.2 mm, especially not larger than 1.0 mm in order to make the crown portion 3 easy to bend. Incidentally, in order to secure the strength, it is preferable that the thickness of the crown portion 3 is not smaller than 0.5 mm, especially not smaller than 0.7 mm. Since balls are not hit on the crown portion 3 directly, it is sufficient that the thickness of the crown portion 3 is not larger than half of the thickness of the face portion 2.

In addition, when the crown portion is partially thinned by rolling or casting, the bending of the crown portion can be further increased.

It is preferable that the thickness of the hosel portion is smaller as long as required strength can be secured. Particularly, it is preferable that the thickness of the hosel portion, which will be disposed inside the golf club head is thinned. In this case, extra weight can be reduced, and it becomes easy to make a design to place the center of gravity near the center of the face surface.

The gold club head, which is particularly effective in application of the invention, is a large-sized golf club head which is easy to bend in its crown portion. Specifically, the volume of such a golf club head is not smaller than 250 cc, preferably not smaller than 300 cc, more preferably not smaller than 350 cc. Incidentally, generally, the weight of the golf club head increases as the volume of the golf club head increases. When the volume thereof increases excessively, it is difficult for golfer to swing the golf club head smoothly. Since there is a limit of weight to any golf club head, it can be considered that the upper limit is placed at about 600 cc. It is preferable that the invention is applied to a driver head whose loft angle is in a range of 7° to 15°.

It is preferable that the height of the face portion of the golf club head is higher because the loft angle increases when a ball is hit on the upper portion of the face surface. Specifically, it is preferable that the maximum face height is not lower than 45 mm, especially not lower than 50 mm, more especially not lower than 53 mm. However, it is not preferable that the face height reaches 100 mm or more, because the resistance of the face surface becomes too large during a swing.

When the golf club head is used as a driver head, the club length is generally in a range of about 43 inch to about 50 inch. In consideration of swing balance, it is preferable that the head weight is in a range of about 165 g to about 205 g. If the head were too heavy, the swing balance might be difficult to catch so that an ordinary golfer cannot fully swing at a ball. On the contrary, if the head were too light, the repulsion of a ball might deteriorate.

In the present invention, a metal material of the crown portion may have the lowest Young's modulus and a metal material of the sole portion may have the highest Young's modulus in the face portion, crown portion, side portion, and sole portion. Combination of materials having different Young's modulus as described above can suppress deformation of the sole portion when hitting a ball and can bend the crown portion more largely.

An example of this mode include a golf club head, which is formed by the following steps of molding a face portion, a side portion, a sole portion, and the like by welding Ti-22V-4AL, heat-treating the welded portion and then welding a crown portion made of Ti-22V-4Al not subjected to heat treatment with the welded portion.

In the present invention, the sole portion may be thicker than the crown portion and the side portion. Specifically, the face portion is made of Ti-15Mo-5Zr-3Sn having high strength and the crown portion is made of Ti-13V-11Cr-3Al. The face portion and the crown portion are formed from plate material having 1.0 mm in thickness. The side portion and the sole portion (including the hosel portion) is made of titanium alloy of Ti-6Al-4V and is molded by casting so that the sole portion has 2.5 mm in thickness and the side portion has 1.6 mm in thickness. These portions are welded to form a hollow golf club head.

In the invention, at least the sole portion may be formed by casting or forging and rib may be formed on the sole portion from the face side thereof toward the back side thereof. In a golf club head having such construction, deformation of the sole portion is small.

In the invention, at least the sole portion may be formed by press-molding and rib may be formed on the sole portion from the face side thereof toward the back side thereof. In a golf club head having such construction, deformation of the sole portion is small.

In the invention, at least the sole portion may be formed by press-molding and crook portion may be formed sequentially from the face side thereof toward the back side thereof as shown in FIG. 3. In such construction, deformation of the sole portion can be suppressed.

EXAMPLE 1

Respective portions configured as shown in FIG. 1, except that the hosel portion 6 was separated from the side portion 5, were produced. These portions were joined by welding so as to produce a golf club head for a driver having a volume of 285 cc. Each of the face portion 2, the crown portion 3, the sole portion 4 and the side portion 5 was produced by press-molding of a titanium alloy plate, while the hosel portion 6 was produced by boring a rod-like piece made of a titanium alloy.

Incidentally, each of the respective portions has a thickness as follows.

face portion: 2.8 mm (even)

crown portion: 1.0 mm (even)

sole portion: 1.15 mm (even)

side portion: 1.15 mm (even)

Table 2 shows the materials of the respective portions and the Young's modulus thereof. As shown in Table 2, Ti-15V-3Cr-3Sn-3Al subjected to cold rolling and having good repulsion performance was used for the face portion, while titanium alloys different in Young's modulus were used for the other portions. Thus, a golf club head was produced. A heat-treated material of Ti-22V-4Al was used as the material having the highest Young's modulus, Ti-15V-3Cr-3Sn-3Al was used as the material having an intermediate Young's modulus, and a non-heat-treated material of Ti-22V-4Al was used as the titanium alloy having the lowest Young's modulus. The portions other than the crown portion were joined by welding and then was subjected to heat treatment and sequentially, the crow portion made of Ti-22V-4Al (non-heat-treated material) was welded to form a golf club head.

The non-heat-treated material of Ti-22V-4Al was kept just as it was press-molded. Thus, the material had a low Young's modulus. Since balls are hit on the face surface directly, the face portion has to be subjected to heat treatment and then subjected to solution treatment, age-hardening treatment or the like. However, since balls are not hit on the crown portion directly, the crown portion does not have to be subjected to heat treatment. Heat treatment was carried out on a golf club head in Comparative Example after the head was molded.

A 45-inch (114 cm) carbon shaft was attached to this golf club head. Thus, a golf club was produced. Table 3 shows test shot evaluation results of the golf club head using a swing robot (head speed 43 m/sec). In addition, Table 4 shows test shot evaluation results using the swing robot (head speed 39 m/sec), and Table 5 shows human test shot evaluation results.

COMPARATIVE EXAMPLE 1

A golf club was produced in the same manner as that in Example 1, except that all the crown portion, the sole portion and the side portion were made of the same titanium alloy as the face portion. Evaluation was carried out similarly. The result is shown in Table 3.

COMPARATIVE EXAMPLE 2

A golf club was produced in the same manner as that in Example 1, except that the materials for forming the crown portion, the sole portion and the side portion were just as shown in Table 2. Evaluation was carried out similarly. The result is shown in Table 3.

TABLE 2

| | face portion | crown portion | sole portion | side portion | difference* |
|---|---|---|---|---|---|
| Example 1 | Ti—15V—3Cr—3Sn—3Al (cold-rolled material) | Ti—22V—4Al (non-heat-treated) | Ti—22V—4Al (heat-treated) | Ti—22V—4Al (heat-treated) | 2,100 |
| modulus** | 10,500 | 8,900 | 11,000 | 11,000 | |
| Example 2 | Ti—15V—3Cr—3Sn—3Al (cold-rolled material) | Ti—22V—4Al (non-heat-treated) | Ti—6Al—4V (heat-treated) | Ti—6Al—4V (heat-treated) | 2,600 |
| modulus** | 10,500 | 8,900 | 11,500 | 11,500 | |
| Example 3 | Ti—15V—3Cr—3Sn—3Al (cold-rolled material) | Ti—22V—4Al (non-heat-treated) | Ti—15V—3Cr—3Al (heat-treated) | Ti—15V—3Cr—3Al (heat-treated) | 1,600 |
| modulus** | 10,500 | 8,900 | 10,500 | 10,500 | |
| Comparative Example 1 | Ti—15V—3Cr—3Sn—3Al (cold-rolled material) | Ti—15V—3Cr—3Sn—3Al | Ti—15V—3Cr—35n—3Al | Ti—15V—3Cr—3Sn—3Al | 0 |
| modulus** | 10,500 | 10,500 | 10,500 | 10,500 | |
| Comparative Example 2 | Ti—15V—3Cr—3Sn—3Al (cold-rolled material) | Ti—22V—4Al (heat-treated) | Ti—22V—4Al (heat-treated) | Ti—22V—4Al (heat-treated) | 0 |
| modulus** | 10,500 | 11,000 | 11,000 | 11,000 | |

TABLE 2-continued

| | face portion | crown portion | sole portion | side portion | difference* |
|---|---|---|---|---|---|
| Comparative Example 3 | Ti—15V—3Cr—3Sn—3Al (heat-treated) | Ti—15V—3Cr—3Sn—3Al (heat-treated) | Ti—22V—4Al (heat-treated) | Ti—22V—4Al (heat-treated) | 500 |
| modulus** | 10,500 | 10,500 | 11,000 | 11,000 | |
| Comparative Example 4 | Ti—15V—3Cr—3Sn—3Al (heat-treated) | Ti—22V—4Al (non-heat-treated) | Ti—8Al—1Mo—1V (heat-treated) | Ti—8Al—1Mo—1V (heat-treated) | 500 |
| modulus** | 10,500 | 8,900 | 12,700 | 12,700 | |

(Note)
Ti—15V—3Cr—3Sn—3Al was a β type.
Ti—22V—4Al was a β type.
*diffference between crown portion and sole portion in Young's modulus · (kgf/mm$^2$)
**Young's modulus (kgf/mm$^2$)

TABLE 3

| | head speed (m/s) | ball initial speed (m/s) | launch angle (degree) | back spin (rpm) | carry (yard) | total distance (yard) |
|---|---|---|---|---|---|---|
| Example 1 | 43 | 60 | 9.2 | 2,764 | 201 | 229 |
| Example 2 | 43 | 60 | 9.3 | 2,862 | 201 | 228 |
| Example 3 | 43 | 60 | 9.0 | 2,810 | 200 | 227 |
| Comp. Ex. 1 | 43 | 60 | 8.7 | 2,746 | 199 | 225 |
| Comp. Ex. 2 | 43 | 60 | 8.3 | 3,014 | 199 | 224 |
| Comp. Ex. 3 | 43 | 60 | 8.3 | 2,880 | 199 | 225 |
| Comp. Ex. 4 | 43 | 60 | 9.4 | 3,102 | 197 | 222 |

TABLE 4

| | head speed (m/s) | ball initial speed (m/s) | launch angle (degree) | back spin (rpm) | carry (yard) | total distance (yard) |
|---|---|---|---|---|---|---|
| Example 1 | 39 | 54.6 | 9.5 | 2,645 | 179 | 202 |
| Example 2 | 39 | 54.6 | 9.5 | 2,665 | 176 | 200 |
| Example 3 | 39 | 54.6 | 9.3 | 2,612 | 179 | 202 |
| Comp. Ex. 1 | 39 | 54.6 | 9.1 | 2,612 | 174 | 197 |
| Comp. Ex. 2 | 39 | 54.6 | 8.5 | 2,690 | 173 | 196 |
| Comp. Ex. 3 | 39 | 54.1 | 8.5 | 2,680 | 173 | 197 |
| Comp. Ex. 4 | 39 | 54.3 | 9.6 | 2,710 | 172 | 196 |

TABLE 5

| | head speed (m/s) | carry (yard) | total distance (yard) |
|---|---|---|---|
| Example 1 | 38 | 176 | 185 |
| Example 2 | 38 | 173 | 180 |
| Example 3 | 38 | 174 | 182 |
| Comp. Ex. 1 | 38 | 163 | 176 |
| Comp. Ex. 2 | 38 | 158 | 172 |
| Comp. Ex. 3 | 38 | 161 | 174 |
| Comp. Ex. 4 | 38 | 170 | 178 |

As shown in Tables 3 to 5, in the golf club head according to Examples 1 to 3, the launch angle increased by about 0.4–0.5° in comparison with that of the golf club head (Comparative Example 1) in which all the crown portion, the sole portion and the side portion were made out of one and the same kind of titanium alloy. In addition, in the golf club head according to Examples 1 to 3, the launch angle increased by about 0.9°–1.0° in comparison with that of the golf club head (Comparative Example 2) in which the material having a high Young's modulus was used for the crown portion. We could recognize the same tendency in Comparative Example 3 having 500 kgf/mm$^2$ in difference between Young's modulus of the crown portion and that of the sole portion. Comparative Example 4 having 3,000 kgf/mm$^2$ in the difference between the Young's modulus of the crown portion and that of the sole portion results in that although launch angle was high, carry decreased.

In accordance with the human test shot, in Examples 1 and 2, the rates of backspin were so low that there occurred a large difference in the carry in comparison with Comparative Examples 1 to 4.

Although the crown portion was made 1.0 mm thick in this evaluation, it was confirmed that the launch angle increased further when the crown portion was made thinner. In addition, it was also confirmed that the launch angle increased when a titanium alloy whose Young's modulus was lower, for example, Ti-15Mo-5Zr or Ti-15Mo-5Zr-3Al was used.

After the test was terminated, the crown portion was examined carefully about damage. No crack or no permanent deformation was recognized therein.

As described above, in a golf club head according to the invention, the launch angle increases even if a golfer having a low head speed uses the golf club head. Thus, the carry can be increased consequently.

What is claimed is:

1. A method for manufacturing a hollow golf club head made of metal including a face portion, a sole portion, a side portion, and a crown portion, the method comprising the steps of:

welding the portions other than the crown portion;

heat-treating the portions; and welding the portions and the crown portion, which is not subjected to a heat treatment.

2. The method according to claim 1, further comprising the steps of press-molding each of face, sole, side, and crown portions.

3. The method according to claim 1, in which the golf club head further including a hosel portion, the method further comprising the steps of:

press-molding a titanium alloy to form the face, sole, side, and crown portions; and punching a titanium alloy stick to form the hosel portion.

4. The method according to claim 1, in which the golf club further includes a hosel portion, the method further comprising the steps of integrally casting the sole, side, and hosel portions.

5. The method according to claim 1, wherein at least the crown portion is made of β type titanium alloy.

* * * * *